US008976371B2

(12) United States Patent
Fukuma

(10) Patent No.: US 8,976,371 B2
(45) Date of Patent: Mar. 10, 2015

(54) SHEET LOADING UNIT HAVING FACE CONNECTING PORTION WITH UPPER EDGE AND INCLINED EDGE

(71) Applicant: KYOCERA Document Solutions Inc., Osaka-shi (JP)

(72) Inventor: Nobuhiro Fukuma, Osaka (JP)

(73) Assignee: Kyocera Document Solutions Inc., Osaka-Shi (JP)

( * ) Notice: Subject to any disclaimer, the term of this patent is extended or adjusted under 35 U.S.C. 154(b) by 0 days.

(21) Appl. No.: 13/857,957

(22) Filed: Apr. 5, 2013

(65) Prior Publication Data

US 2013/0265600 A1 Oct. 10, 2013

(30) Foreign Application Priority Data

Apr. 9, 2012 (JP) ..... 2012-088091

(51) Int. Cl.
*B65H 9/08* (2006.01)
*B65H 1/04* (2006.01)

(52) U.S. Cl.
CPC .. *B65H 9/08* (2013.01); *B65H 1/04* (2013.01); *B65H 2405/1112* (2013.01); *B65H 2511/12* (2013.01); *B65H 2511/22* (2013.01)
USPC ..... 358/1.12; 271/145; 271/171

(58) Field of Classification Search
USPC ..... 358/1.12; 271/145–171
See application file for complete search history.

(56) References Cited

U.S. PATENT DOCUMENTS

2007/0114713 A1* 5/2007 Yonemoto ..... 271/171
2012/0205859 A1* 8/2012 Nishioka ..... 271/145

FOREIGN PATENT DOCUMENTS

JP S59-088048 U 6/1984
JP 2011-126686 6/2011

OTHER PUBLICATIONS

Notice of Reasons for Rejection issued to JP Application No. 2012-088091, mailed Jul. 29, 2014.

* cited by examiner

*Primary Examiner* — Qian Yang
(74) *Attorney, Agent, or Firm* — Knobbe Martens Olson & Bear LLP

(57) ABSTRACT

The present disclosure includes a pair of cursor members movable in a width direction, and guide grooves configured to guide the cursor member to move in the width direction. The cursor member includes a cursor base, a cursor rising portion being in contact with or in proximity to an end of the sheet, and a connecting portion. The cursor base has a cursor plane extending in parallel to a sheet loading face with a difference of step with respect to the sheet loading face. An edge in the width direction of the cursor base extends linearly. The connecting portion extends from the sheet loading face side to a reverse side via the guide groove at a portion in the feeding direction of the inside edge of the cursor base. The connecting portion has a face connecting portion which connects the sheet loading face with the cursor plane smoothly.

6 Claims, 9 Drawing Sheets

SHEET LOADING UNIT HAVING FACE CONNECTING PORTION WITH UPPER EDGE AND INCLINED EDGE

INCORPORATION BY REFERENCE

This application is based upon and claims the benefit of priority from the corresponding Japanese Patent Application No. 2012-088091, filed in the Japan Patent Office on Apr. 9, 2012, the entire contents of which are incorporated herein by reference.

BACKGROUND

The present disclosure relates to a sheet loading unit provided with a sheet loading face on which sheets to be fed to an image forming unit of an image forming apparatus or sheets to be fed to an image reading unit of an image reading apparatus are loaded. Further, the present disclosure relates to an image forming apparatus and an image reading apparatus, provided with the sheet loading unit.

The image forming apparatus such as a copying machine, a printer and a facsimile includes an apparatus main body containing an image forming unit configured to form an image on a sheet such as a paper. The image forming apparatus often includes a sheet supply cassette provided inside its apparatus main body or a sheet supply tray provided outside or inside the apparatus main body (referred to as "manual feeding tray").

The manual feeding tray includes a sheet loading portion, cursor members, and a guide groove. The sheet loading portion has a sheet loading face on which sheets to be fed to the image forming unit are loaded. The cursor members are a pair of cursor members movable in a width direction of a sheet orthogonal to a sheet feeding direction on the sheet loading face to restrict a position of the sheet in the width direction. The guide groove is provided in the sheet loading face and extends in the width direction of the sheet to guide the cursor member to move in the width direction. The cursor member includes a cursor base, a cursor rising portion and a connecting portion. The cursor base has a cursor plane extending substantially in parallel to the sheet loading face with a difference of step with respect to the sheet loading face. The cursor rising portion rises relative to the cursor plane and is in contact with or in proximity to an edge of the sheet in a width direction thereof to restrict a position of the sheet in the width direction. The connecting portion is connected to the cursor base at a portion in the feeding direction of the inside edge in the width direction of the cursor base and extends from the sheet loading face side to a reverse side via the guide groove.

In the manual feeding tray having the above-described structure, a user places a sheet on the sheet loading face, moves the cursor members inward in the width direction of the sheet, arranges an end portion in the width direction of the sheet on the cursor plane of the cursor base and further brings the cursor rising portion into contact with or proximity to the end portion in the width direction of the sheet. Consequently, a position in the width direction of the sheet can be restricted.

However, in the aforementioned manual feeding tray, a gap (difference in step) may be formed easily between the sheet loading face and the cursor base. Then, when the cursor members are moved inward in the width direction of the sheet, an end portion in the width direction of the sheet sometimes may enter the gap between the sheet loading face and the cursor base. In this case, the end portion in the width direction of the sheet is not placed on the cursor plane of the cursor base. As a consequence, it comes that no position in the width direction of the sheet is restricted by the cursor rising portion. This problem also may occur in a sheet loading unit other than the manual feeding tray, for example, a sheet feeding cassette or an original document tray in an original document feeding unit.

SUMMARY

In an example embodiment according to this disclosure, A sheet loading unit according to an aspect of the present disclosure includes a sheet loading portion, cursor members and guide grooves. The sheet loading portion has a sheet loading face on which a sheet to be fed to a feeding destination is loaded. The cursor members are a pair of the cursor members movable in the width direction of the sheet orthogonal to the sheet feeding direction on the sheet loading face to restrict a position in the width direction of the sheet. The guide grooves are provided in the sheet loading face of the sheet loading portion and extend in the width direction to guide the cursor member to move in the width direction. The cursor member includes a cursor base, a cursor rising portion and a connecting portion. The cursor base has a cursor plane extending substantially in parallel to the sheet loading face with a difference of step with respect to the sheet loading face. The cursor rising portion rises relative to the cursor plane and is in contact with or in proximity to an edge of the sheet in the width direction thereof to restrict a position of the sheet in the width direction. The connecting portion extends from the sheet loading face side to a reverse side via the guide groove at a portion in the feeding direction of an inside edge in the width direction of the cursor base. The edge of the cursor base extends linearly in the sheet feeding direction. The connecting portion has a face connecting portion which connects the sheet loading face with the cursor plane smoothly.

An image forming apparatus according to an aspect of the present disclosure includes an image forming unit configured to form an image on a sheet and the sheet loading unit in which the image forming unit is a feeding destination thereof.

An image reading apparatus according to an aspect of the present disclosure includes an image reading unit configured to read an image formed on the sheet and the sheet loading unit in which the image reading unit is the feeding destination thereof.

DETAILED DESCRIPTION

Figure 1:
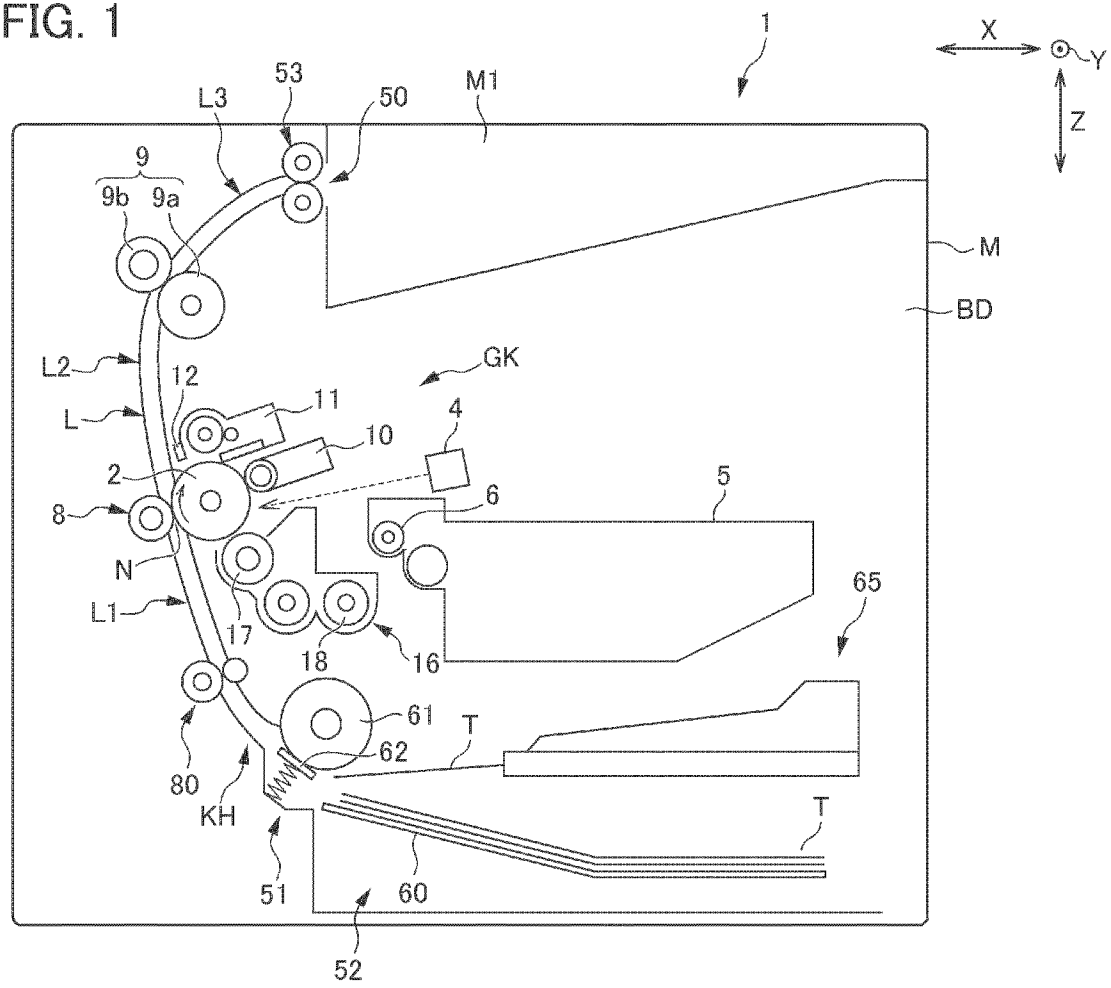
FIG. 1 is a diagram for describing arrangement of components of a printer 1 according to a first embodiment of the present disclosure.

Example apparatus and method are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Hereinafter, an embodiment of the present disclosure will be described with reference to the accompanying drawings.

First Embodiment

Figure 2:
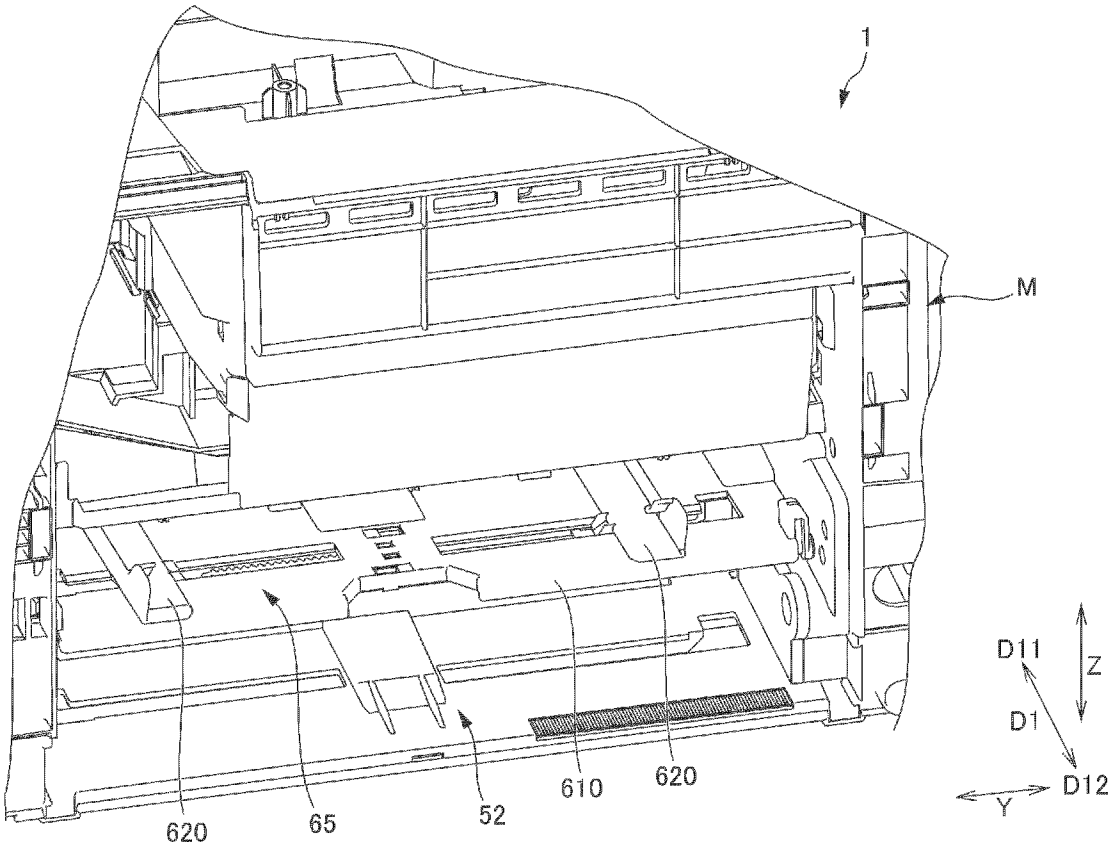
FIG. 2 is a perspective view illustrating a manual feeding tray 65 and an apparatus main body M with part of a casing body removed in the printer 1 of the first embodiment.

The entire structure of a printer 1 as an image forming apparatus according to the first embodiment of the present disclosure will be described with reference to FIGS. 1, 2. FIG. 1 is a diagram for describing arrangement of components of the printer 1 according to the first embodiment of the present disclosure. FIG. 2 is a perspective view illustrating a manual feeding tray 65 and an apparatus main body M with part of a casing body removed in the printer 1 of the first embodiment. In a following description, as viewed from a user standing in front of the printer 1, it is assumed that the right-and-left direction is X-direction, the back-and-forth (depth) direction is Y-direction and the up-and-down (vertical) direction is Z-direction.

As shown in FIG. 1, the printer 1 as an image forming apparatus includes an apparatus main body M, an image forming unit GK, and a paper feeding/discharging unit KH. The image forming unit GK forms a predetermined toner image on a paper T as a sheet based on predetermined image information. The paper feeding/discharging unit KH feeds a paper T to the image forming unit GK and discharges the paper T on which the toner image has been formed. An external structure of the apparatus main body M is constituted of a casing body BD which serves as a casing for this apparatus.

As shown in FIG. 1, the image forming unit GK includes a photoconductor drum 2 which serves as an image carrying body (photosensitive body), a charging unit 10, a laser scanner unit 4 which serves as an exposure unit, a developing unit 16, a toner cartridge 5, a toner supplying unit 6, a cleaning device 11, a neutralization unit 12, a transfer roller 8, and a fuser unit 9.

As shown in FIG. 1, the paper feeding/discharging unit KH includes a paper feeding cassette 52, a manual feeding tray 65 which serves as a sheet loading portion, a conveyance path L for the paper T, a registration roller pair 80, and a paper ejection unit 50.

Hereinafter, each structure of the image forming unit GK and the paper feeding/discharging unit KH will be described in detail. In the image forming unit GK, charging by the charging unit 10, exposure by the laser scanner unit 4, development by the developing unit 16, transfer by the transfer roller 8, neutralization by the neutralization unit 12 and cleaning by the cleaning device 11 are sequentially performed in order from the upstream side to the downstream side along a surface of the photoconductor drum 2.

The photoconductor drum 2 is configured with a cylindrical member and functions as a photosensitive body or an image carrying body. The photoconductor drum 2 is arranged to be rotatable in a direction indicated by an arrow about a rotational shaft which extends in a direction orthogonal to a direction in which the paper sheet T is conveyed through the conveyance path L. An electrostatic latent image may be formed on the surface of the photoconductor drum 2.

The charging unit 10 is disposed to face the surface of the photoconductor drum 2. The charging unit 10 negatively or positively charges the surface of the photoconductor drum 2 uniformly (with negative or positive polarity).

The laser scanner unit 4 functions as an exposure unit and is disposed to be spaced apart from the surface of the photoconductor drum 2.

The laser scanner unit 4 scans and exposes the surface of the photoconductor drum 2 based on image information that is input from an external device such as a PC (personal computer). In this way, an electrostatic latent image is formed on the surface of the photoconductor drum 2.

The developing unit 16 is provided in correspondence with the photoconductor drum 2 and is disposed to face the surface of the photoconductor drum 2. The developing unit 16 causes single color toner (black toner in general) to adhere to an electrostatic latent image formed on the photoconductor drum 2, and thereby forms a single color toner image on the surface of the photoconductor drum 2. The developing unit 16 is configured with a developing roller 17 disposed to face the surface of the photoconductor drum 2, an agitation roller 18 for agitating toner, and the like.

The toner cartridge 5 is provided in correspondence with the developing device 16 and stores toner to be supplied to the developing unit 16.

The toner supply unit 6 is provided in correspondence with the toner cartridge 5 and the developing device 16 and supplies toner stored in the toner cartridge 5 to the developing unit 16. The toner supply unit 6 and the developing unit 16 are connected with each other via a toner feed passage (not shown).

The transfer roller 8 transfers a toner image, which has been developed on the surface of the photoconductor drum 2, onto the paper T. A transfer bias application unit (not shown) applies a transfer bias to the transfer roller 8. The transfer roller 8 is configured to be rotatable in a state of abutting the photoconductor drum 2.

A transfer nip N is formed between the photoconductor drum 2 and the transfer roller 8. In the transfer nip N, a toner image developed on the photoconductor drum 2 is transferred onto the paper T.

The neutralization unit 12 is disposed to face the surface of the photoconductor drum 2. By radiating the surface of the photoconductor drum 2 with light, the neutralization unit 12 discharges electricity (neutralizes electrical charge) on the surface of the photoconductor drum 2, onto which the transfer has been performed.

The cleaning device 11 is disposed to face the surface of the photoconductor drum 2. The cleaning device 11 removes toner and attached matters on the surface of the photoconductor drum 2. The cleaning device 11 conveys the toner and the like thus removed to a predetermined collection mechanism for collection.

By melting and pressurizing the toner that forms a toner image transferred onto the paper T, the fuser unit 9 fixes the toner on the paper T. The fuser unit 9 includes a heating rotator 9*a* that is heated by a heater and a pressing rotator 9*b* that is brought into pressure-contact with the heating rotator 9*a*. The heating rotator 9*a* and the pressing rotator 9*b* interpose, press and convey the paper T with the toner image transferred thereon. The paper T is conveyed in a state of being sandwiched between the heating rotator 9*a* and the pressing rotator 9*b*, thereby fusing, pressurizing and fixing the toner transferred thereto.

Next, the paper/discharge portion KH will be described. As shown in FIGS. 1, 2, a paper feeding cassette 52 for storing the paper T is disposed in a lower portion of the apparatus main unit M. The paper feeding cassette 52 is configured to be open to the right side of the apparatus main unit M (to the right side in FIG. 1). The papers T are inserted through the open portion on the right side and stored in the paper feeding cassette 52. The paper feeding cassette 52 includes a paper tray 60 on which the papers T are loaded. The papers T are stored such that they are loaded on the paper tray 60 in the paper feeding cassette 52. The paper T loaded on the paper tray 60 is fed by a cassette feeding unit 51 disposed at an end portion of the paper feeding unit 52 on a side of feeding the paper (at a left end portion of FIG. 1) to a conveyance path L. The cassette feeding unit 51 includes a pickup roller 61 and a separating member 62. The pickup roller 61 feeds the paper T loaded on the paper tray 60 one by one to the conveyance path L. The separating member 62 is disposed to face the pickup roller 61 and urged toward the pickup roller 61.

As shown in FIGS. 1, 2, a manual feeding tray 65 which serves as a sheet loading unit is provided above the paper feeding cassette 52 within the apparatus main unit M. A main purpose of the manual feeding tray 65 is to supply the paper T having a different size and kind from the paper T set in the paper feeding cassette 52 to the image forming unit GK. The manual feeding tray 65 is configured to be open to the right side of the apparatus main unit M (to the right in FIG. 1). The paper T is inserted through the right open portion and loaded on the manual feeding tray 65. The manual feeding tray 65 allows the paper T to be loaded thereon such that only one sheet or a plurality of the papers T is loaded. The paper T loaded in the manual feeding tray 65 is fed into the conveyance path L by the cassette feeding unit 51. The manual feeding tray 65 will be described below in detail.

A paper ejection unit 50 is provided on an upper side of the apparatus main unit M. The paper ejection unit 50 ejects the paper T to the outside of the apparatus main unit M by way of a third pair of rollers 53.

The conveyance path L that conveys the paper T includes: a first conveyance path L1 which extends from the cassette feeding unit 51 to the transfer nip N; a second conveyance path L2 which extends from the transfer nip N to the fuser unit 9; and a third conveyance path L3 which extends from the fuser unit 9 to the paper ejection unit 50.

A sensor for detecting the paper T as well as the registration roller pair 80 are disposed in the middle of the first conveyance path L1 (more specifically, between the pickup roller 61 and the transfer roller 8). The registration roller pair 80 is designed for skew compensation of the paper T (oblique feeding of the paper T) and timing adjustment between formation of the toner image and conveyance of the paper T in the image forming unit GK. The sensor is disposed just before the registration roller pair 80 (on the upstream side in a conveyance direction) in the conveyance direction of the paper T. The registration roller pair 80 performs the above-described compensation and timing adjustment based on detection signal information from the sensor and conveys the paper T.

The paper ejection unit 50 is formed at an end portion on the downstream side of the third conveyance path L3. The paper ejection unit 50 is disposed in an upper portion of the apparatus main unit M. The paper ejection unit 50 has an opening toward a right lateral face of the apparatus main unit M (right side in FIG. 1). The paper ejection unit 50 ejects the paper T conveyed through the third conveyance path L3 to the outside of the apparatus main unit M by way of the third roller pair 53.

An ejected paper accumulating portion M1 is formed on the opening side of the paper ejection unit 50. The papers T, which are ejected from the paper ejection unit 50, are loaded and collected in the ejected paper accumulating portion M1. A sensor for detecting a sheet of paper is disposed at a predetermined position of each conveyance path.

Figure 3:
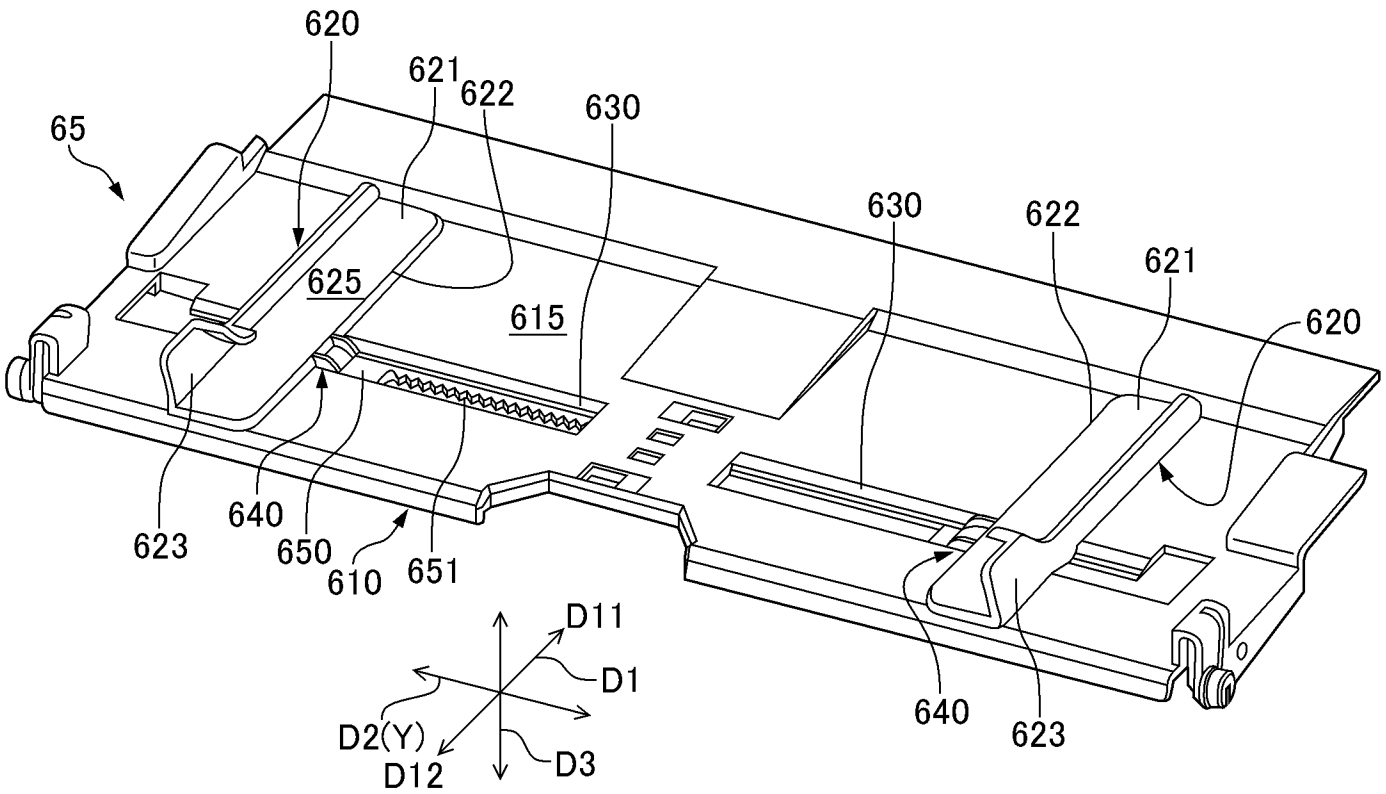
FIG. 3 is a perspective view of the manual feeding tray 65 of the first embodiment taken from an upstream side (D12 side) in a sheet feeding direction D1 toward a downstream side (D11 side) or a diagram illustrating a state in which a pair of the cursor members 620 is arranged outward in the width direction D2.
Figure 4:
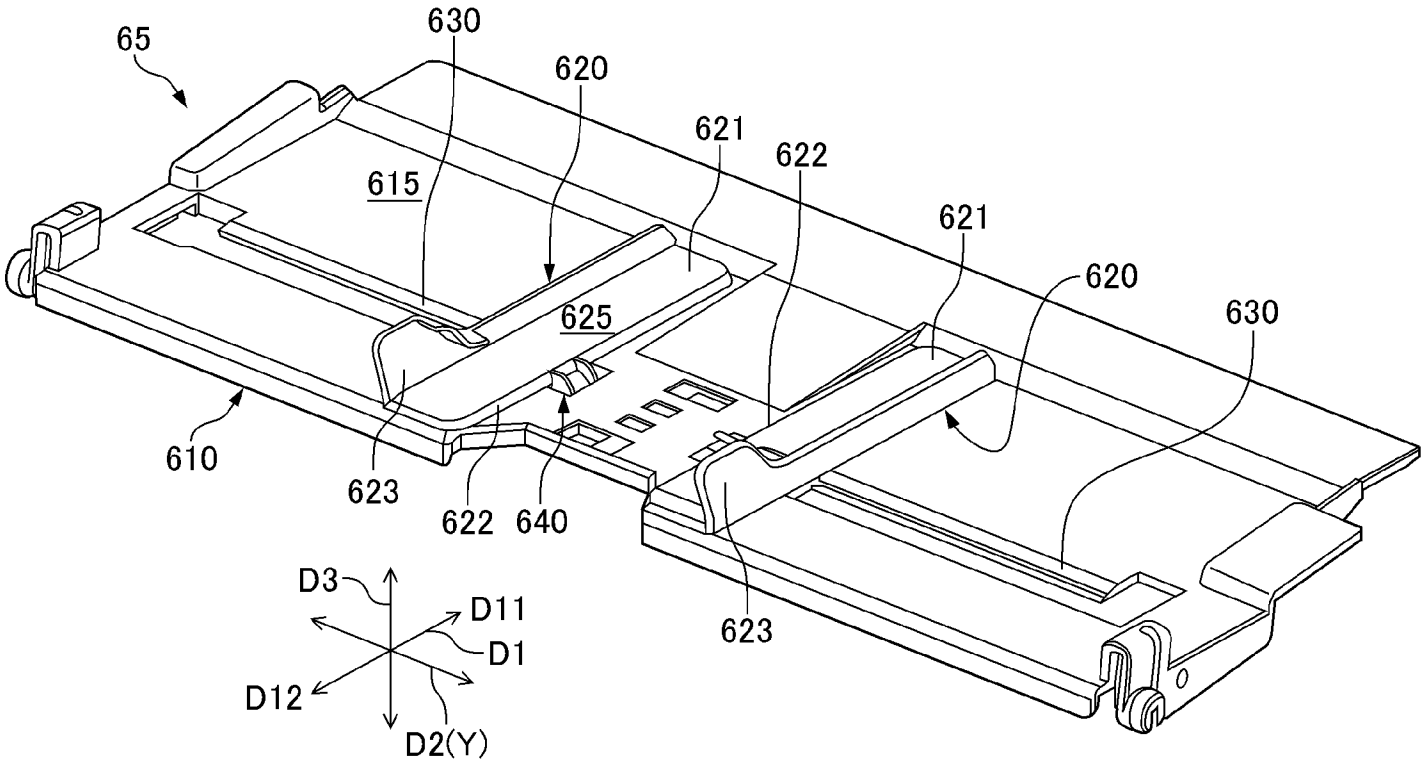
FIG. 4 is a perspective view of the manual feeding tray 65 of the first embodiment taken from the upstream side (D12 side) in the sheet feeding direction D1 toward the downstream side (D11 side) or a diagram illustrating a state in which the pair of the cursor members 620 is arranged inward in the width direction D2.
Figure 5:
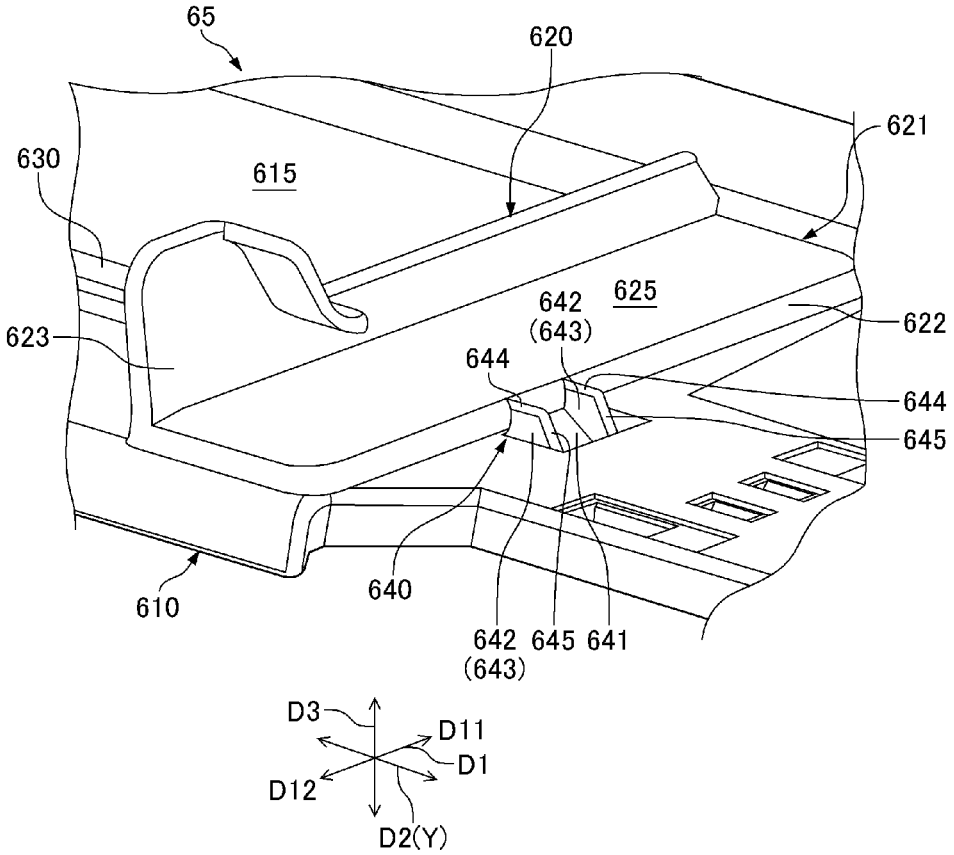
FIG. 5 is a partially-enlarged perspective view showing the cursor member 620 arranged on the sheet loading face 615 side.
Figure 6:
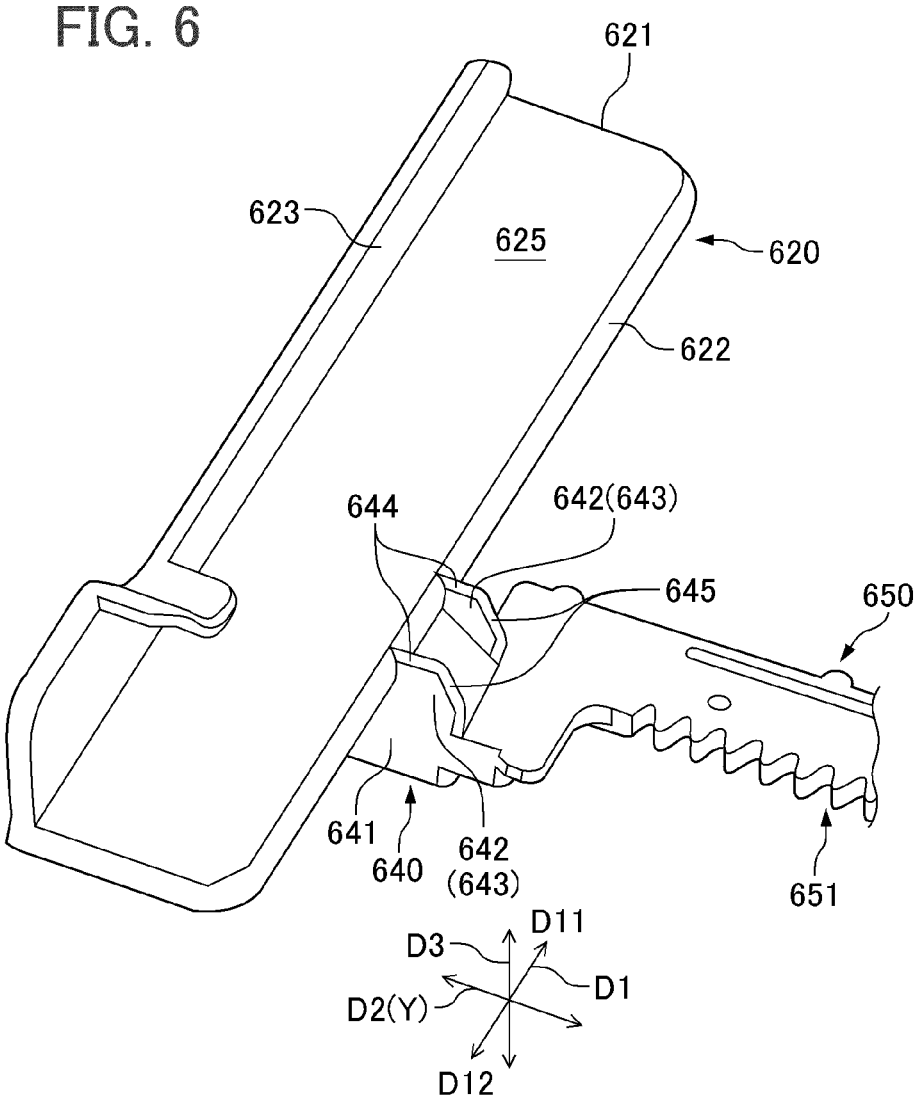
FIG. 6 is a partially-enlarged perspective view showing the cursor member 620 and a rack member 650 of the first embodiment.

Next, the manual feeding tray 65, which is the sheet loading unit of the first embodiment, will be described in detail. FIG. 3 is a perspective view of the manual feeding tray 65 of the first embodiment taken from an upstream side (D12 side) in a sheet feeding direction D1 toward a downstream side (D11 side) or a diagram illustrating a state in which a pair of the cursor members 620 is arranged outward in the width direction D2. FIG. 4 is a perspective view of the manual feeding tray 65 of the first embodiment taken from the upstream side (D12 side) in the sheet feeding direction D1 toward the downstream side (D11 side) or a diagram illustrating a state in which the pair of the cursor members 620 is arranged inward in the width direction D2. FIG. 5 is a partially-enlarged perspective view showing the cursor member 620 arranged on the sheet loading face 615 side. FIG. 6 is a partially-enlarged perspective view showing the cursor member 620 and a rack member 650 of the first embodiment.

As shown in FIGS. 1, 2, the manual feeding tray 65 is provided above the paper feeding cassette 52 inside the apparatus main unit M such that it is supported by the apparatus main unit M. A feed destination of the paper T in the manual feeding tray 65 is the image forming unit GK. As shown in FIGS. 3 to 6, the manual feeding tray 65 includes a tray main body 610 which serves as a sheet loading portion, a pair of the cursor members 620, a pair of guide grooves 630, and a rack member 650.

The tray main body 610 constitutes a main body of the manual feeding tray 65 and has a substantially rectangular plate-like shape. The tray main body 610 has the sheet loading face 615 on which the paper T (see FIG. 7) is placed to be fed to the image forming unit GK, the sheet loading face 65 being provided on an upper side thereof. The sheet loading face 615 is inclined such that the downstream side D11 in the feeding direction D1 of the paper T descends. The paper T loaded on the sheet loading face 615 is fed to the first conveyance path L1 by the cassette feeding unit 51.

The pair of the cursor members 620, 620 are members which are disposed on the upper side of the sheet loading face 615 and are movable in the width direction D2 of the paper T. The width direction D2 is a direction orthogonal to both the feeding direction D1 of the paper T and the thickness direction D3 of the paper T and agrees with the back-and-forth (depth) direction Y of the apparatus main body M of the printer 1. The cursor members 620 restrict a position in the width direction D2 of the paper T loaded on the sheet loading face 615.

The cursor member 620 includes a cursor base portion 621, a cursor rising portion 623, and a connecting portion 640. The cursor base 621 has a cursor plane 625 which extends substantially in parallel to the sheet loading face 615 with a difference of step therebetween, on an upper side thereof. This difference of step is a sum of a gap between the sheet loading face 615 and a bottom face of the cursor base 621 and a thickness of an edge (hereinafter also referred to as inside edge) 622 in the width direction D2 of the cursor base 621. This difference of step is, for example, 2 mm to 4 mm. The inside edge 622 of the cursor base 621 extends linearly and in parallel to the feeding direction D1. The cursor rising portion 623 rises with respect to the cursor plane 625 and is in contact with or in proximity to the edge T1 (see FIG. 7) in the width direction D2 of the paper T to restrict a position in the width direction D2 of the paper T. The cursor rising portion 623 is connected to an outside portion in the width direction D2 of the cursor base 621 and extends linearly and in parallel to the feeding direction D1.

A pair of the guide grooves 630, 630 is provided in the sheet loading face 615 of the tray main body 610 in correspondence with each of the cursor members 620, 620. The guide groove 630 extends along the width direction D2 to guide the cursor member 620 to move in the width direction D2.

As shown in FIGS. 3 to 6, the rack member 650 is provided on a reverse side of the sheet loading face 615 of the tray main body 610 in correspondence with the cursor member 620. The rack member 650 extends in the width direction D2 and has rack teeth 651 extending in the width direction D2 on a side edge along the width direction D2. The rack teeth 651 mesh with pinion teeth of a pinion member (not shown) provided on the reverse side of the sheet loading face 615 of the tray main body 610. A single pinion member is provided for a pair of the rack members 650 in common. The pinion teeth of the pinion member mesh with each of the pair of the rack members 650. In consequence, when one rack member 650 is moved inward in the width direction D2, the other rack member 650 moves inward in the width direction D2 through the rack teeth 651 and the pinion teeth of the pinion member. Likewise, when one rack member 650 is moved outward in the width direction D2, the other rack member 650 moves outward in the width direction D2.

Because the cursor member 620 is connected to the rack member 650 via the connecting portion 640, the cursor member 620 moves integrally with the rack member 650. More specifically, when one cursor member 620 is moved inward in the width direction D2, the other cursor member 620 is moved inward in the width direction D2. Likewise, when one cursor member 620 is moved outward in the width direction D2, the other cursor member 620 is moved outward in the width direction D2.

The connecting portion 640 is connected to the cursor base 621 at a portion in the feeding direction D1 of the inside edge 622 of the cursor base 621 (in the present embodiment, central portion in the feeding direction D1). The connecting portion 640 extends to the reverse side (opposite side) from the sheet loading face 615 side via the guide groove 630 and is connected to the rack member 650.

The connecting portion 640 includes a connecting portion main body 641 and a face connecting portion 642. The connecting portion main body 641 is connected to a bottom face (opposite face to the cursor plane 625) of the cursor member 620 via an outside portion in the width direction D2 of the connecting portion main body 641. The connecting portion main body 641 extends inward in the width direction D2 with respect to the inside edge 622 of the cursor base portion 621 and is connected to an outside end portion in the width direction D2 of the rack member 650.

The face connecting portion 642 connects the sheet loading face 615 with the cursor plane 625 smoothly. The face connecting portion 642 has a substantially same width (a width slightly smaller than the width of the guide groove 630) as the width of the guide groove 630 (length thereof in the feeding direction D1). The face connecting portion 642 is constituted of a pair of ribs 643, 643 which are spaced in the feeding direction D1. The ribs 643 extend in a direction orthogonal to the feeding direction D1 (D2-D3 plane). The rib 643 is connected to the inside edge 622 of the cursor base 621 of the cursor member 620 via an outside portion thereof in the width direction D2. The rib 643 is connected to the connecting portion main body 641 via a lower portion thereof. Further, the width (length in the feeding direction D1) of the face connecting portion 642 may be larger than the width of the guide groove 630.

The rib 643 of the face connecting portion 642 includes an upper edge 644 and an inclined edge 645. The upper edge 644 extends substantially in parallel to the cursor plane 625 at a substantially same height as the cursor plane 625. The length of the upper edge 644 is, for example, 2 mm to 4 mm. "Substantially same height" means that a difference of the height is 0.5 mm or less. "Substantially in parallel" means that an angle formed between the both is 5° or less. In other view, the upper edge 644 extends inward in the width direction horizontally from the cursor plane 625.

In the meantime, the upper edge 644 may be inclined slightly inward in the width direction D2 and in a direction in which it approaches the sheet loading face 615. In this case, preferably, an inclination angle of the upper edge 644 is 0° to 5° with respect to a direction in which the sheet loading face 615 extends.

The inclined edge 645 extends obliquely from the upper edge 644 up to the guide groove 630. The inclination angle of the inclined edge 645 is for example, 30° to 65° with respect to a direction in which the sheet loading face 615 extends (D1-D2 plane).

Figure 7A:
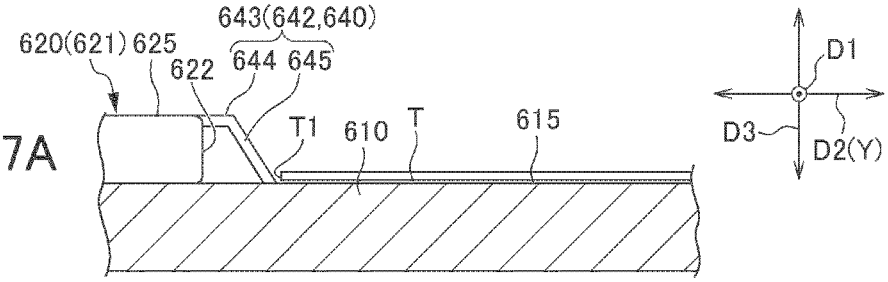
FIGS. 7A to 7E are cross-sectional views showing operations of the manual feeding tray 65 according to the first embodiment in order.

Next, an operation of restricting a position in the width direction of the paper T by moving the pair of the cursor members 620 inward in the width direction D2 such that they approach each other in the manual feeding tray 65 of the first embodiment will be described with reference to FIGS. 7A to 7E. FIGS. 7A to 7E are cross-sectional views illustrating an operation of the manual feeding tray 65 of the first embodiment in succession. As illustrated in FIG. 7A, the paper T is placed on the sheet loading face 615 of the tray main body 610. An end T1 of the paper T does not ride on the cursor member 620 (more specifically, connecting portion 640).

Figure 7B:
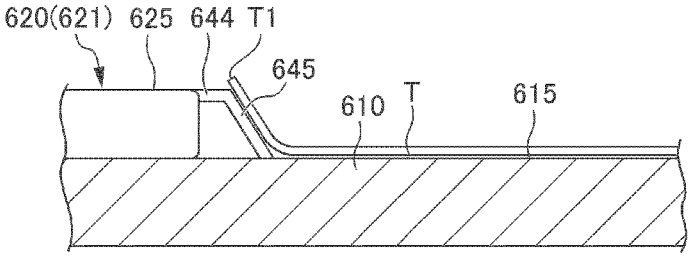

When the cursor member 620 (connecting portion 640) is moved inward in the width direction D2 as illustrated in FIG. 7B, the end T1 of the paper T is picked up by the inclined edge 645 of the rib 643 smoothly (for example, so that the end T1 of the paper T does not enter a gap between the sheet loading face 615 of the tray main body 610 and a bottom face of the cursor member 620) and brought up to a position above the upper edge 644 of the rib 643.

Figure 7C:
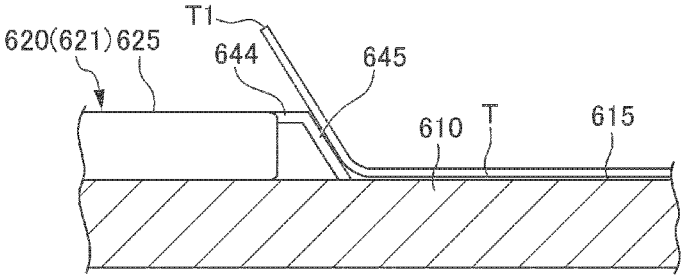

As illustrated in FIG. 7C, when the cursor member 620 (connecting portion 640) is moved further inward in the width direction D2, the end T1 of the paper T moves further upward.

Figure 7D:
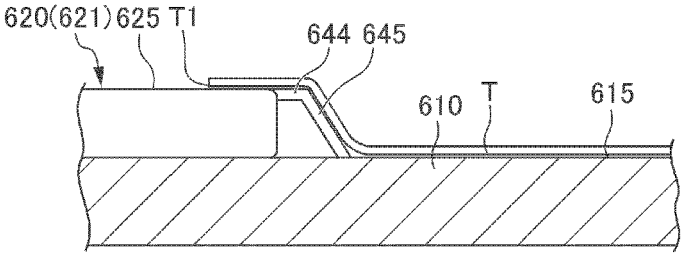

As shown in FIG. 7D, the end T1 of the paper T brought up to a position above the upper edge 644 of the rib 643 moves (falls) to the cursor plane 625 side, so that it moves onto the upper edge 644 of the rib 643 and the cursor plane 625 of the cursor base 621 of the cursor member 620 smoothly.

Figure 7E:
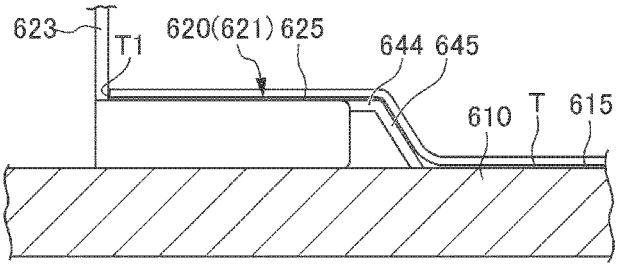

As illustrated in FIG. 7E, when the cursor member 620 (connecting portion 640) is moved further inward in the width direction D2, the end T1 of the paper T is brought into contact with or in proximity to an inside face in the width direction D2 of the cursor rising portion 623 of the cursor member 620. Consequently, a position in the width direction D2 of the paper T is restricted.

According to the first embodiment, for example, following advantages are attained. The first embodiment includes the pair of the cursor members 620 and the guide grooves 630. The pair of the cursor members 620 is movable in the width direction D2 on the sheet loading face 615. The guide groove 630 guides movement of the cursor member 620 in the width direction D2. The cursor member 620 includes the cursor base 621, the cursor rising portion 623 and the connecting portion 640. The cursor base 621 includes the cursor plane 625 which extends substantially in parallel to the sheet loading face 615 with a difference of step relative to the sheet loading face 615. The cursor rising portion 623 rises relative to the cursor plane 625 and comes into contact with or in proximity to the end in the width direction D2 of the paper T. The connecting portion 640 extends from the sheet loading face 615 side to the reverse side thereof through the guide groove 630. The connecting portion 640 has the face connecting portion 642 which connects the sheet loading face 615 with the cursor plane 625 smoothly.

Thus, according to the first embodiment, when the cursor member 620 (connecting portion 640) is moved inward in the width direction D2, the end T1 of the paper T is brought up by the face connecting portion 642 smoothly. For example, the end T1 of the paper T is brought up without entering a gap between the sheet loading face 615 of the tray main body 610 and the cursor base 621 of the cursor member 620 and coming into contact with or proximity to the inside edge 622 of the cursor member 620. Then, the end T1 of the paper T is moved onto the cursor plane 625 of the cursor base 621 of the cursor member 620 smoothly. Consequently, the end T1 of the paper T is arranged on the cursor plane 625 of the cursor base 621 smoothly, so that a position in the width direction D2 of the paper T can be restricted by the cursor rising portion 623 easily.

According to the first embodiment, the face connecting portion 642 includes the upper edge 644 and the inclined edge 645. The upper edge 644 extends substantially in parallel to the cursor plane 625 at a substantially same height as the cursor plane 625. The inclined edge 645 extends obliquely from the upper edge 644 up to the guide groove 630.

Therefore, when the cursor member 620 (connecting portion 640) is moved inward in the width direction D2, as shown in FIG. 7B, the end T1 of the paper T is brought up by the inclined edge 645 of the rib 643 smoothly and further, brought up to a position above the upper edge 644 of the rib 643.

When the cursor member 620 (connecting portion 640) is moved further from the state indicated in FIG. 7B, the paper T does not droop over a short period due to rigidity of the paper T. Thus, as shown in FIG. 7C, the end T1 of the paper T moves further upward. When preventing the paper T from drooping due to rigidity of the paper T becomes impossible so that as shown in FIG. 7D, the paper T moves onto the cursor plane 625 side (droops), the end T1 of the paper T has passed the inside edge 622 of the cursor member 620. Consequently, at a position where no face connecting portion 642 exists of the cursor member 620, the paper T is never hooked by the cursor member 620 or enters a gap between the sheet loading face 615 of the tray main body 610 and a bottom face of the cursor base 621 of the cursor member 620.

Then, as shown in FIG. 7D, when the cursor member 620 (connecting portion 640) is moved further, the end T1 of the paper T brought up to a position above the upper edge 644 of the rib 643 is moved onto the upper edge 644 of the rib 643 and the cursor plane 625 of the cursor base 621 of the cursor member 620 smoothly. Thus, the end T1 of the paper T can be moved onto the cursor plane 625 more smoothly.

The upper edge 644 and the inclined edge 645 are provided on each of the pair of the ribs 643 which serve as the face connecting portion 642, spaced in the feeding direction D1. Consequently, when the end T1 of the paper T is moved on the cursor plane 625, friction generated between the face connecting portion 642 and the paper T can be reduced.

Second embodiment

Figure 8:
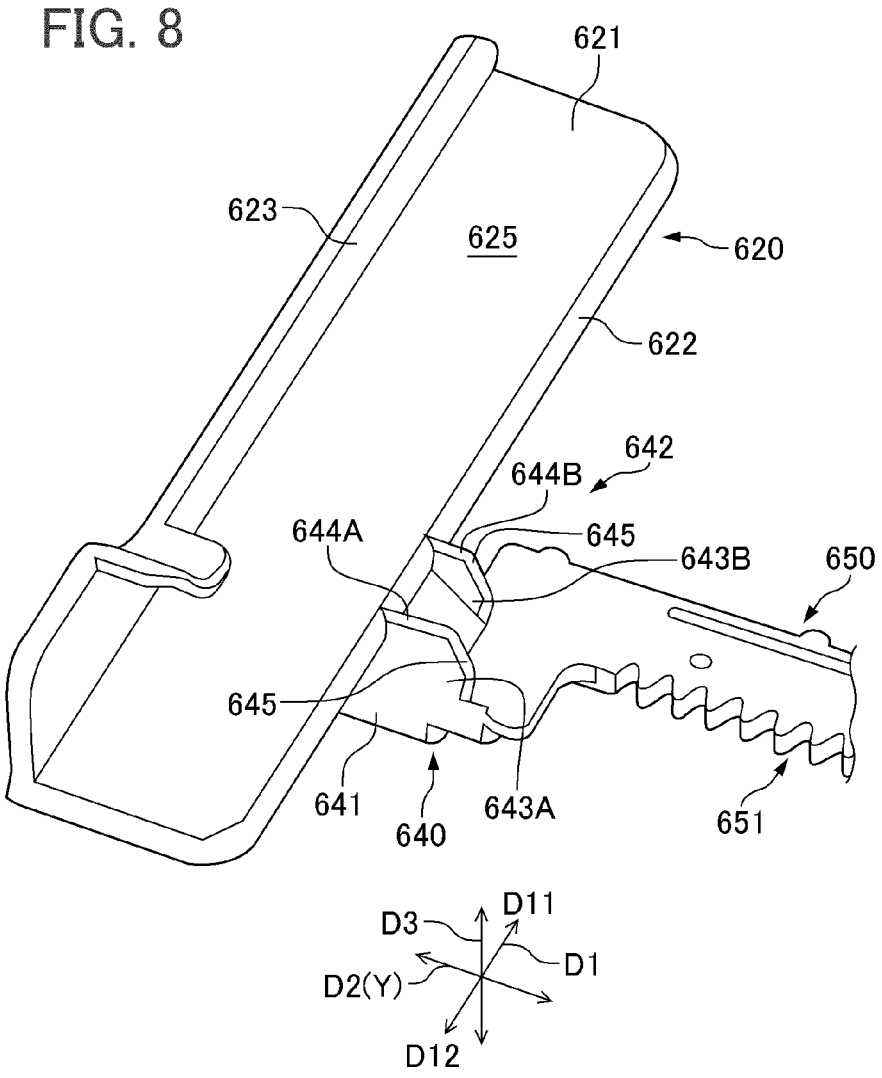
FIG. 8 is a partially-enlarged perspective view illustrating the cursor member 620 and the rack member 650 of a second embodiment.

Next, the cursor member 620 and the like according to the second embodiment will be described with reference to the drawings. In description of the second embodiment and a third embodiment, similar constituent features to the first embodiment are referred to by the same numerals and descriptions thereof are omitted or simplified. FIG. 8 is a partially-enlarged perspective view illustrating the cursor member 620 and the rack member 650 of the second embodiment.

As shown in FIG. 8, in the second embodiment, mainly the configuration of the upper edge 644A of the rib 643A and the upper edge 644B of the rib 643B are different from the rib 643 of the first embodiment. In the second embodiment, a length of the upper edge 644A of the rib 643A on the upstream side (D12 side) in the feeding direction D1 of the paper T is larger than a length of the upper edge 644B of the rib 643B on a downstream side (D11 side) in the feeding direction D1. A difference between the length of the upper edge 644A and the length of the upper edge 644B is, for example, 1 mm to 3 mm.

In the second embodiment, a following advantage is attained as well as the advantage of the first embodiment. In the present embodiment, the length of the upper edge 644A of the rib 643A on the upstream side (D12 side) in the feeding direction D1 is larger than the length of the upper edge 644B of the rib 643B on the downstream side (D11 side). Thus, the upstream side (D12 side) in the feeding direction D1 of the paper T placed on the sheet loading face 615, the face connecting portion 642 and the cursor plane 625 can be brought up more than the downstream side (D11 side). As a result, the paper T cannot come into contact with the rib 643B on the downstream side (D11 side) easily. Thus, when the paper T placed on the sheet loading face 615, the face connecting portion 642 and the cursor plane 625 is fed toward the image forming unit GK, the paper T is unlikely to be hooked by the rib 643B on the downstream side (D1 side).

Third embodiment

Figure 9:
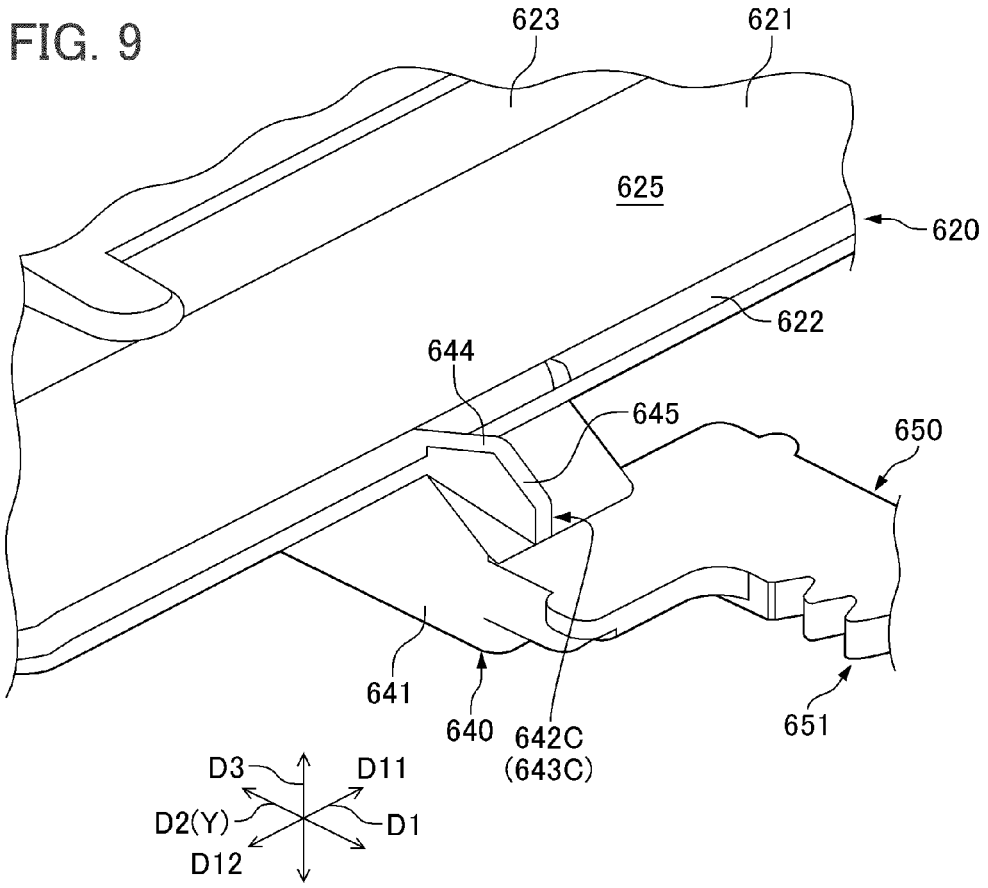
FIG. 9 is a partially-enlarged perspective view illustrating the cursor member 620 and the rack member 650 of a third embodiment.

Next, the cursor member 620 and the like according to the third embodiment will be described with reference to the drawings. FIG. 9 is a partially-enlarged perspective view illustrating the cursor member 620 and the rack member 650 of a third embodiment.

As shown in FIG. 9, in the third embodiment, mainly its rib 643C is different from the rib 643 of first embodiment. In the third embodiment, a face connecting portion 642C has the rib 643C on the upstream side D12 in the feeding direction D1. On the other hand, the face connecting portion 642 has no rib on the downstream side D11 in the feeding direction D1.

When viewed from a direction orthogonal to the sheet loading face 615 (thickness direction D3 of the paper T), the upper edge 644 of the rib 643C extends obliquely toward the downstream side (D11 side) in the feeding direction D1 with respect to the width direction D2 from the inside edge 622 of the cursor base 621. An angle (sharp angle) formed by the width direction D2 and a direction in which the rib 643C extends is, for example, 30° to 60° when viewed in a direction orthogonal to the sheet loading face 615.

The third embodiment provides a following advantage as well as the advantage provided by the first embodiment. In the present embodiment, when viewed in a direction orthogonal to the sheet loading face 615, the upper edge 644 of the face connecting portion 642C (rib 643C) extends obliquely toward the downstream side (D11 side) in the feeding direction D1 with respect to the width direction D2 from the inside edge 622 of the cursor base 621. Thus, compared to a case where the rib of the face connecting portion 642 extends in parallel to the width direction D2 and a case where it extends obliquely toward the upstream side (D12 side) in the feeding direction D1 with respect to the width direction D2, such a phenomenon that the paper T may be hooked by the rib 643C of the face connecting portion 642 when the paper T placed on the sheet loading face 615, the face connecting portion 642C and the cursor plane 625 is fed to the image forming unit GK, can be eliminated more easily. Thus, the paper T is hardly hooked by the rib 643C of the face connecting portion 642.

Although the embodiments of the present disclosure have been described above, the present disclosure is not restricted to the above-described embodiments but may be carried out in a variety of embodiments. For example, in the present embodiments, although the present disclosure is applied to the manual feeding tray 65 provided inside the apparatus main body M, the present disclosure is not restricted to this example. The manual feeding tray may be of a type which is provided outside the apparatus main body M.

In addition, the present disclosure can be applied to a sheet storage unit (generally referred to as feed cassette) capable of storing loaded sheets each to be fed to the image forming unit GK. Further, the present disclosure can be applied to an original document carrying unit configured to feed (carry) an original document which is a sheet on which an image is formed to an image reading unit for reading the image. The image reading unit may be a unit which constitutes part of an image forming apparatus or a unit which constitutes part of an image reading apparatus (generally referred to as scanner) which is not an image forming apparatus.

According to the present embodiments, when one cursor member 620 is moved, the other cursor member 620 moves synchronously therewith. However, the cursor members 620 may be configured so that with one cursor member 620 fixed (unmovable), only the other cursor member 620 is movable.

Although in the present embodiments, the monochrome printer 1 has been described as the image forming apparatus, they are not restricted thereto. The image forming apparatus may be a copying machine, a color printer, a facsimile or a multifunction peripheral containing these functions.

The invention claimed is:

1. A sheet loading unit comprising:

a sheet loading portion having a sheet loading face on which a sheet to be fed to a feeding destination is loaded;

a pair of cursor members movable in a width direction of the sheet orthogonal to a sheet feeding direction on the sheet loading face to restrict a position in the width direction of the sheet; and guide grooves that are provided in the sheet loading face of the sheet loading portion and extend in the width direction to guide the pair of cursor members to move in the width direction, wherein each of the pair of cursor members includes: a cursor base having a cursor plane extending substantially in parallel to the sheet loading face with a difference of step with respect to the sheet loading face;

a cursor rising portion that rises relative to the cursor plane and is in contact with or in proximity to an edge of the sheet in the width direction thereof to restrict a position of the sheet in the width direction; and a connecting portion that extends from a sheet loading face side to a reverse side thereof via each of the guide grooves at a portion in the sheet feeding direction of an inside edge in the width direction of the cursor base, wherein the edge of the cursor base extends linearly in the sheet feeding direction, wherein the connecting portion has a face connecting portion which connects the sheet loading face with the cursor plane smoothly, and wherein the face connecting portion includes an upper edge that extends horizontally inward in the width direction from the cursor plane and an inclined edge that extends from the upper edge up to each of the guide grooves in an inclined state, wherein the upper edge and the inclined edge of the face connecting portion are structured with a pair of ribs spaced in the sheet feeding direction, wherein in the pair of the ribs, a length of an upper edge of one of the pair of ribs on an upstream side in the sheet feeding direction is larger than a length of an upper edge of the other of the pair of ribs on a downstream side in the sheet feeding direction.

2. The sheet loading unit according to claim 1, wherein the upper edge of the face connecting portion extends from the edge of the cursor base downstream in the sheet feeding direction obliquely with respect to the width direction.

3. The sheet loading unit according to claim 1, wherein the upper edge of the face connecting portion extends from the edge of the cursor base downstream in the sheet feeding direction obliquely with respect to the width direction.

4. The sheet loading unit according to claim 1, further comprising: a pair of rack members that are provided on the reverse side of the sheet loading face in correspondence with the pair of the cursor members and a pinion member provided on the reverse side of the sheet loading face, wherein the connecting portion connects the cursor members with the rack members;

wherein each of the rack members extends in the width direction and has rack teeth that extend in the width direction on a side edge along the width direction;

wherein the rack teeth mesh with pinion teeth of the pinion member.

5. An image forming apparatus comprising: an image forming unit configured to form an image on a sheet; and the sheet loading unit according to claim 1 wherein the image forming unit is the feeding destination.

6. An image reading apparatus comprising: an image reading unit configured to read an image formed on a sheet; and the sheet loading unit according to claim 1 wherein the image reading unit is the feeding destination.

* * * * *